US005690072A

United States Patent [19]

Meyer et al.

[11] Patent Number: 5,690,072

[45] Date of Patent: Nov. 25, 1997

[54] METHOD AND SYSTEM FOR DETERMINING AND CONTROLLING A/F RATIO IN LEAN ENGINES

[75] Inventors: Garth M. Meyer, Dearborn; Joseph R. Asik, Bloomfield Hills, both of Mich.

[73] Assignee: Ford Global Technologies, Inc., Dearborn, Mich.

[21] Appl. No.: 768,002

[22] Filed: Dec. 13, 1996

[51] Int. Cl.[6] ..... F02D 41/14

[52] U.S. Cl. ..... 123/436; 73/117.3; 364/431.054

[58] Field of Search ..... 123/436, 443, 123/419; 73/117.3; 364/431.054

[56] References Cited

U.S. PATENT DOCUMENTS 4,991,555 2/1991 Tamekio ..... 123/436

FOREIGN PATENT DOCUMENTS 3124909 5/1991 Japan .
5231136 9/1993 Japan .
5231137 9/1993 Japan .
5231138 9/1993 Japan .
5312026 11/1993 Japan .
7071234 3/1994 Japan .
6093845 4/1994 Japan .
6330741 11/1994 Japan .
7293233 11/1995 Japan .
7305644 11/1995 Japan .
7310534 11/1995 Japan .
8004522 1/1996 Japan .
8061052 3/1996 Japan .
8100639 4/1996 Japan .
8105318 4/1996 Japan .
8121147 5/1996 Japan .

*Primary Examiner*—Andrew M. Dolinar
*Attorney, Agent, or Firm*—Allan J. Lippa; Roger L. May

[57] ABSTRACT

A method and system for determining and controlling air/fuel ratio during lean engine operation relies on applying a small fuel pulse width modulation to the engine and synchronously measuring the effect of the modulation on related engine event periods. This effect is utilized in estimating air/fuel ratio, which is then compared to the desired air/fuel ratio. The difference between the estimated air/fuel ratio and the desired air/fuel ratio is used in controlling the air/fuel ratio to the desired air/fuel ratio.

18 Claims, 5 Drawing Sheets

METHOD AND SYSTEM FOR DETERMINING AND CONTROLLING A/F RATIO IN LEAN ENGINES

CROSS-REFERENCE TO RELATED APPLICATION

This application is related to co-pending application Ser. No. 08/768,001 entitled "Method and System for Controlling Combustion Stability for Lean-Burn Engines," filed Dec. 13, 1996.

TECHNICAL FIELD

This invention relates to methods and systems for estimating and controlling air/fuel ratio during lean engine operation.

BACKGROUND ART

It is desirable to determine and control air/fuel ratio during an enleanment condition in order to improve fuel economy, control engine emissions, and maintain acceptable vehicle performance. Air/fuel ratio can be directly measured utilizing an UEGO (Universal Exhaust Gas Oxygen) sensor. However, an LIEGO sensor adds cost to a vehicle and affects reliability.

A technique for operating an engine efficiently without directly measuring the air/fuel ratio is known as the Schweitzer optimizer technique. In this technique, the air/fuel ratio and spark timing are continually varied to find a maximum rpm (rotation per minute). The maximum rpm corresponds to a maximum torque point. By operating the engine at peak torque, the engine is operated efficiently. The Schweitzer technique, however, cannot be utilized to control air/fuel ratio under lean air/fuel conditions, such as air/fuel ratio >18:1. This technique also requires near steady-state operation.

DISCLOSURE OF THE INVENTION

It is thus a general object of the present invention to provide a method to infer, estimate and control air/fuel ratio during lean engine operation utilizing pre-existing engine sensors rather than a dedicated air/fuel ratio sensor.

In carrying out the above object and other objects, features, and advantages of the present invention, a method is provided for estimating and controlling air/fuel ratio. The method includes the steps of sensing an engine coolant temperature and generating a corresponding temperature signal and sensing a cylinder air mass and generating a corresponding air mass signal. The method also includes the step of modulating a base fuel pulse width to the fuel injector according to a predetermined event schedule, including a rich fuel pulse width relative to the base fuel pulse width and a lean fuel pulse width relative to the base fuel pulse width based on the temperature signal and the air mass signal. Still further, the method includes the step of determining a rich event time in response to the rich fuel pulse width and a lean event time in response to the lean fuel pulse width. The method further includes the steps of determining a metric based on the rich event time and the lean event time and determining the air/fuel ratio based on the metric, the temperature signal and the air mass signal. Finally, the method includes the step of controlling the engine based on the determined air/fuel ratio.

In further carrying out the above object and other objects, features, and advantages of the present invention, a system is also provided for carrying out the steps of the above described method. The system includes a temperature sensor for sensing an engine coolant temperature and generating a corresponding temperature signal. The system also includes an air mass sensor for sensing a cylinder air mass and generating a corresponding air mass signal. Still further, the system includes control logic operative to modulate a base fuel pulse width to the fuel injector according to a predetermined event schedule including a rich fuel pulse width relative to the base fuel pulse width and a lean fuel pulse width relative to the base fuel pulse width based on the temperature signal and the air mass signal, determine a rich event time in response to the rich fuel pulse width and a lean event time in response to the lean fuel pulse width, determine a metric based on the rich event time and the lean event time, determine the air/fuel ratio based on the metric, the temperature signal and the air mass signal, and control the engine based on the determined air/fuel ratio.

The above object and other objects, features and advantages of the present invention are readily apparent from the following detailed description of the best mode for carrying out the invention when taken in connection with the accompanying drawings.

BEST MODE FOR CARRYING OUT THE INVENTION

Figure 1:
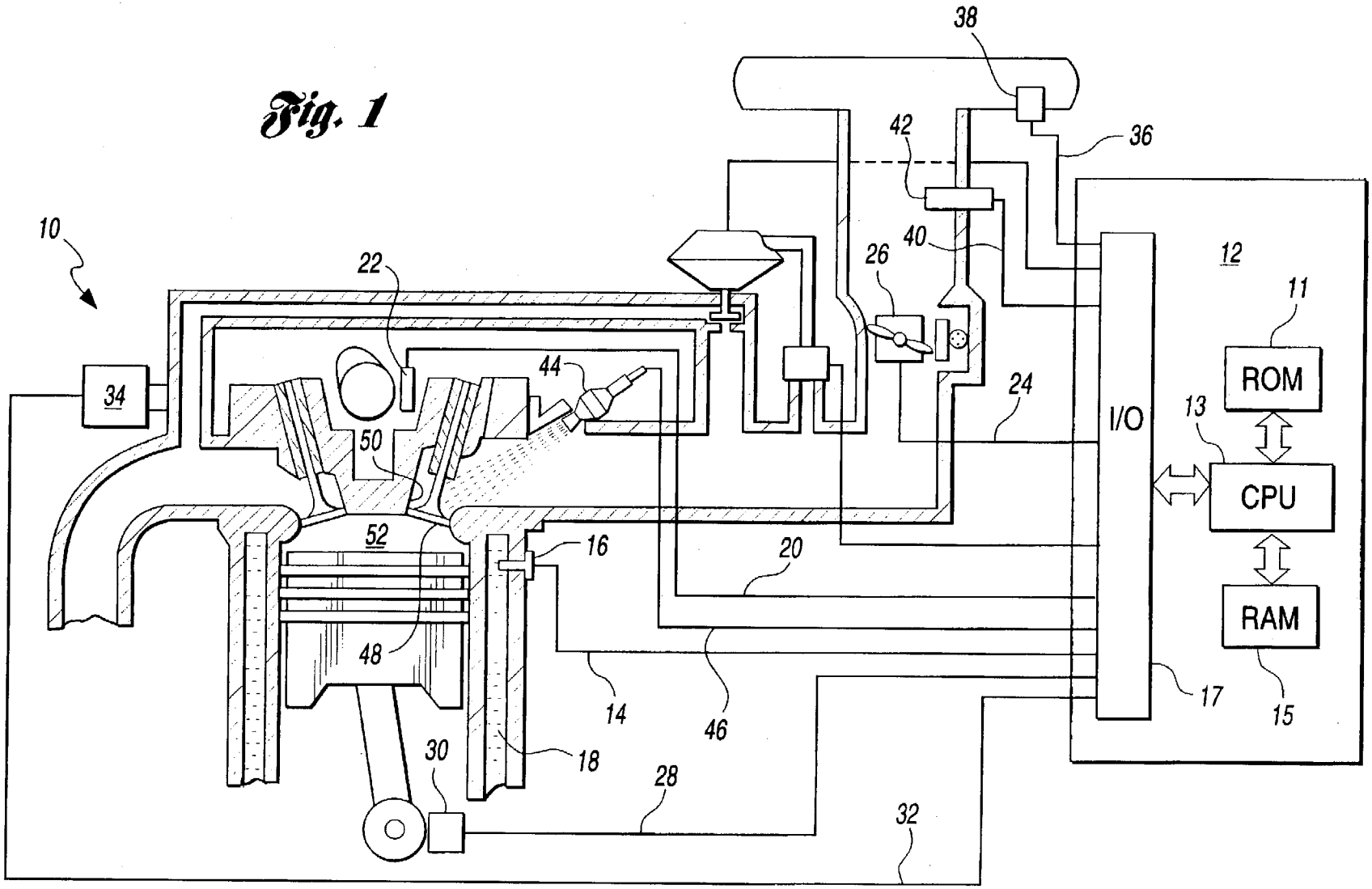
FIG. 1 is a block diagram of the system of the present invention.

Turning now to FIG. 1, there is shown an internal combustion engine which incorporates the teachings of the present invention. The internal combustion engine 10 comprises a plurality of combustion chambers, or cylinders, one of which is shown in FIG. 1 at 52. The engine 10 is controlled by an Electronic Control Unit (ECU) 12 having a Read Only Memory (ROM) 11, a Central Processing Unit (CPU) 13, and a Random Access Memory (RAM) 15. The ECU 12 receives a plurality of signals from the engine 10 via an Input/Output (I/O) port 17, including, but not limited to, an Engine Coolant Temperature (ECT) signal 14 from an engine coolant temperature sensor 16 which is exposed to engine coolant circulating through coolant sleeve 18, a Cylinder Identification (CID) signal 20 from a CID sensor 22, a throttle position signal 24 generated by a throttle position sensor 26, a Profile Ignition Pickup (PIP) signal 28 generated by a PIP sensor 30, a Heated Exhaust Gas Oxygen (HEGO) signal 32 from a HEGO sensor 34, an air intake temperature signal 36 from an air temperature sensor 38, and an air flow signal 40 from an air flow meter 42. The ECU 12 processes these signals received from the engine and generates a fuel injector pulse waveform transmitted to the fuel injector 44 on signal line 46 to control the amount of fuel delivered by the fuel injector 44. Intake valve 48 operates to open and close intake port 50 to control the entry of the air/fuel mixture into combustion chamber 52.

The air/fuel ratio estimator and controller described in this disclosure is based on inducing and detecting crankshaft speed fluctuations caused by modulating the engine's fuel injection pulse widths utilizing a predetermined event pattern. Fuel pulse width modulation produces a corresponding modulation of the instantaneous combustion air/fuel (A/F) ratio and indicated mean effective pressure, or IMEP. IMEP corresponds to the pressure on a piston that results in an average torque. Modulation of IMEP modulates the instantaneous crankshaft velocity since IMEP is proportional to instantaneous engine torque. Synchronous event-based measurement of crankshaft velocity provides a basic metric that, together with other engine state parameters, can be used to estimate A/F ratio independent of data from an exhaust gas oxygen sensor.

Figure 2:
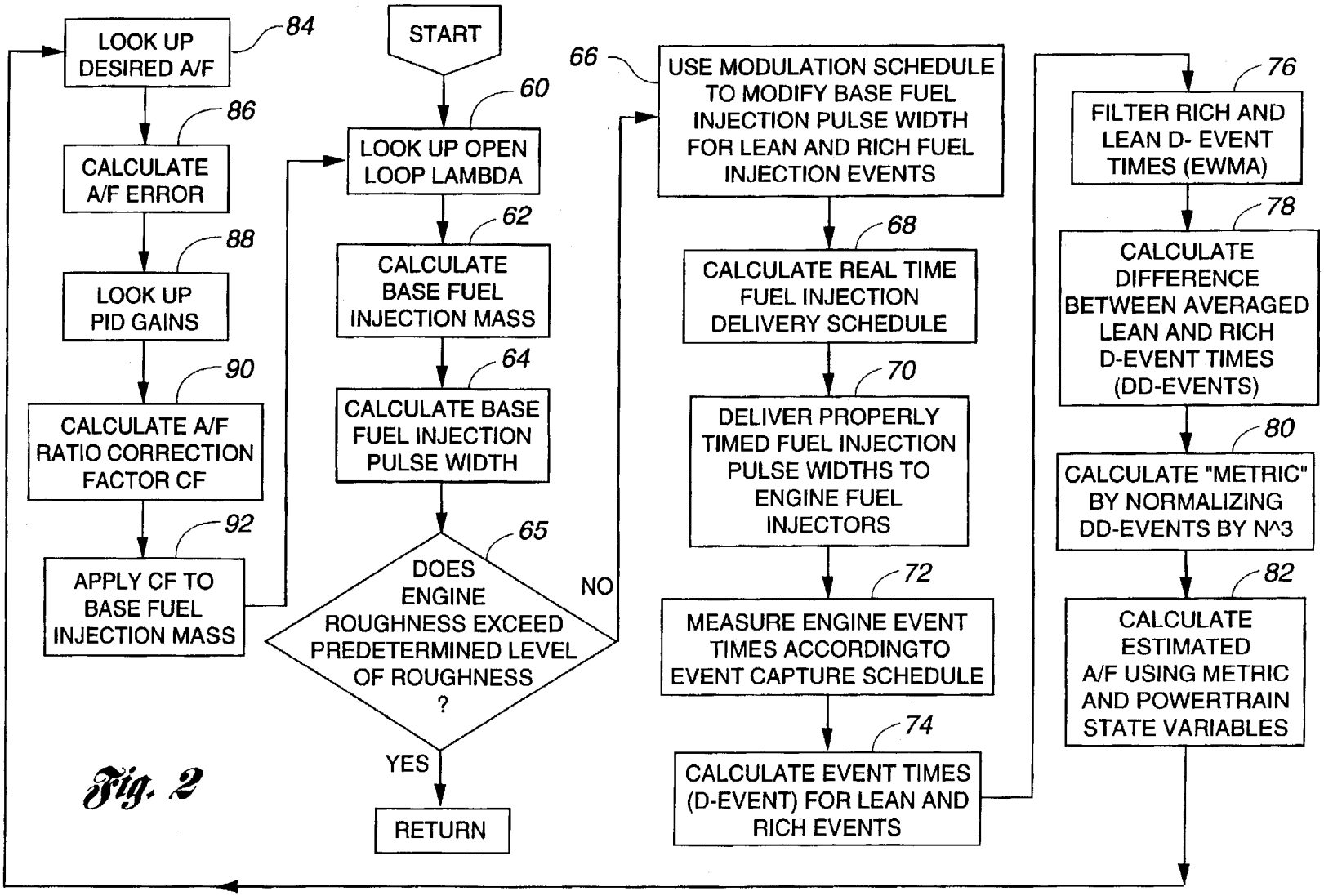
FIG. 2 is a flow diagram illustrating the general sequence of steps associated with the operation of the present invention.

The operation of the A/F ratio estimator and controller of the present invention will now be described in conjunction with the flow diagram of FIG. 2, which illustrates a routine performed by a control logic, or the ECU 12. The ECU 12 may be comprised of hardware, software, or a combination thereof, as described above. Although the steps shown in FIG. 2 are depicted sequentially, they can be implemented utilizing interrupt-driven programming strategies, object-oriented programming, or the like. In a preferred embodiment, the steps shown in FIG. 2 comprise a portion of a larger routine which performs other engine control functions.

The method begins with the step of determining an open loop lambda, as shown at block 60. Lambda corresponds to A/F ratio with respect to stoichiometry, i.e., lambda equals (actual A/F ratio/14.65), where 14.65 corresponds to stoichiometric A/F ratio for typical gasoline. Next, a base fuel injection mass is determined, as shown at block 62. The base fuel injection mass is determined in accordance with the following: Base Fuel Injection Mass=(Air Mass)/(14.65× Lambda), where Air Mass, known as the cylinder air charge, corresponds to the mass flow rate of incoming air as indicated by the air flow signal A base fuel injection pulse width is then determined based on the base fuel injection mass, as shown at block 64. The base fuel injection pulse width corresponds to the base fuel injection mass adjusted for time and the flow characteristics of the fuel injector 44. Next, the method proceeds to determine if the current level of engine roughness exceeds a predetermined level of roughness, as shown at conditional block 65. The predetermined level of roughness corresponds to a maximum level of roughness the vehicle can withstand before reaching instability. One method for determining a level of engine roughness is disclosed in co-pending patent application Ser. No. 08/768,001 entitled "Method and System for Controlling Combustion Stability for Lean-Burn Engines," filed Dec. 13, 1996. If the engine roughness exceeds the predetermined roughness threshold, the routine is exited. If not, the method proceeds to apply a modulation schedule to the base fuel injection pulse width, as shown at block 66. The modulation schedule is determined based on state variables, such as engine coolant temperature, cylinder air charge mass, and integrated engine air mass. The amplitude of the fuel injection pulse width modulation is varied based upon these state variables. The fuel injection pulse width modulation is also varied according to a predetermined event pattern.

Figure 3:
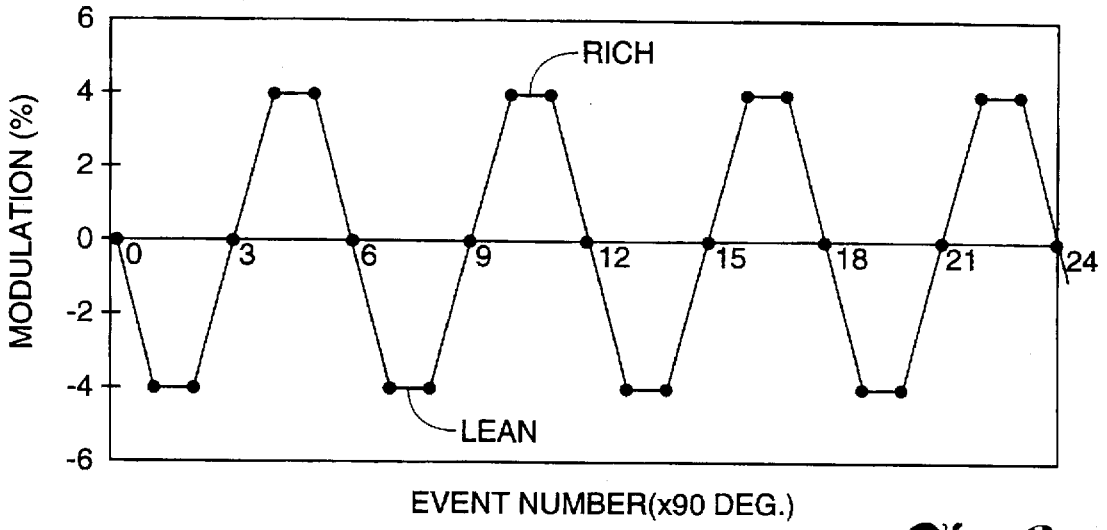
FIG. 3 is an example of a predetermined modulation schedule utilized in the method of the present invention.

An example of a predetermined modulation schedule for an eight cylinder engine is shown in FIG. 3, in which two rich fuel injection events and two lean fuel injection events are alternated around the base fuel injection pulse width. The magnitude of this modulation is small enough (±4% within the cylinder) that it has not been observed to affect either the closed loop control performance or the engine emissions. The real time delivery schedule of the fuel injection pulse widths is determined at block 68, followed by the actual delivery of the fuel injection pulse widths to the fuel injector 44 (FIG. 1) at block 70.

Figure 4:
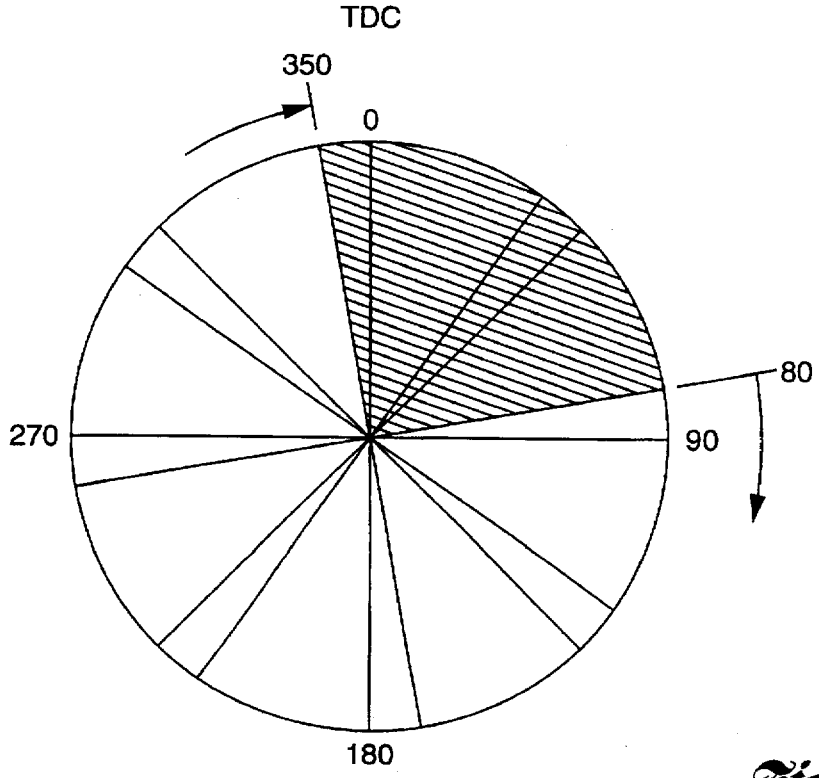
FIG. 4 is a chart illustrating the capture window for a typical eight cylinder engine event.

Next, the engine event times $T_n$ are measured according to an event capture schedule, as shown at block 72. FIG. 4 is a chart illustrating a capture window for a typical engine event. The capture window width of 270 degrees starts at 80 degrees after Top Dead Center (TDC) and ends at 10 degrees before TDC. The capture window is large to allow for wide variations in spark advance and combustion torque characteristics. The size and location of the capture window may be varied for different engines and operating conditions. Spark retard affects the shape of the torque curve and also delays the angle of the peak in cylinder pressure from about 15 degrees after TDC to significantly later. A first capture window for engine events is set up after a pair of rich fuel pulse widths and a second capture window is set up for engine events occurring after a pair of lean fuel pulse widths.

Once the capture start period begins, a current timer value is captured. A second timer value is then captured at the end of the capture window. These two times for each window are used to determine the event times, $T_{lean}$ and $T_{rich}$, for the lean and rich events, respectively. The time difference between the lean and rich capture windows is then calculated, as shown at block 74, and passed through an exponentially weighted moving average (EWMA) filter, as shown at block 76. The event times are calculated and filtered in order to statistically remove timing variations not caused by fuel modulation. By averaging two uniformly distributed samples at a population differentiated only by the state of fuel modulation, other variations cancel out. Variations cancelled include timing mark registration errors, cylinder air charge differences, injector flow rate differences, cylinder temperature, cylinder deposits, compression ratio, cylinder burn rate, etc. The difference between the lean and rich filtered event times is calculated, as shown at block 78, to obtain a partial metric, $\delta T=\delta(T_n-T_{n-1})$, where $T_n$=event time for lean fuel events and $T_{n-1}$=event time for rich fuel events. The partial metric is proportional to the instantaneous engine acceleration.

A final metric, $(N/1000)^3*\delta T$, is then calculated next by normalizing the partial metric, as shown at block 80. An $N^3$ normalization is used in order to calculate an instantaneous change in angular acceleration from the instantaneous change in engine event time. The engine 10 and processor 12 determine the gain and location of the averaging filters to produce the most useful metric and A/F ratio estimate.

The metric is derived as follows. Consider reference rotational timing marks for an engine separated by equal angular segments $\Delta\theta$. The measured angular velocities of two selected segments, respectively, are $$\omega_L=\Delta\theta/t_L \text{ and } \omega_R=\Delta\theta/\Delta t_r,$$

where the measured time intervals between two successive angular segments are $\Delta t_L$ and $\Delta t_R$, corresponding to capture windows for lean (L) and rich (R) events, respectively. The average angular acceleration $a_L$ from a normal to a lean event is given by $$a_L=(\omega_L-\omega_0)/\Delta t_{OL}=2(\omega_L-\omega_0)/(\Delta t_L+\Delta t_0),$$

since $\Delta t_{OL}\approx\Delta t_L/2+\Delta t_0/2$. $\omega_0$ corresponds to the angular velocity during the normal event $\Delta t_0$. Defining $\Delta t_L=\Delta t_L-\Delta t_0$, we find since $\Delta t_L \approx \Delta t_0 = \Delta\theta/N$. The average angular acceleration $a_R$ from a normal to a rich event is given by $$a_R = 2(\omega_R - \omega_0)/(\Delta t_R + \Delta t_0) = -N^3 \delta\Delta t_R/(\Delta\theta)^2,$$

where $\delta t_R = \Delta t_R - \Delta t_0$ and $\Delta t_R \approx \Delta t_0 = \Delta\theta/N$. The difference in acceleration $\delta a$ between lean and rich event is given by $$\delta a = a_R - a_L = N^3 \delta t/(\Delta\theta)^2,$$

where $\delta t = \Delta t_L - \Delta t_R$. Thus, $\delta a \propto N^3 * \delta t$. For our case of an 8 cylinder engine, $\Delta\theta$ was chosen equal to 270° or $3\pi/2$, the capture window described in FIG. 4.

Figure 5:
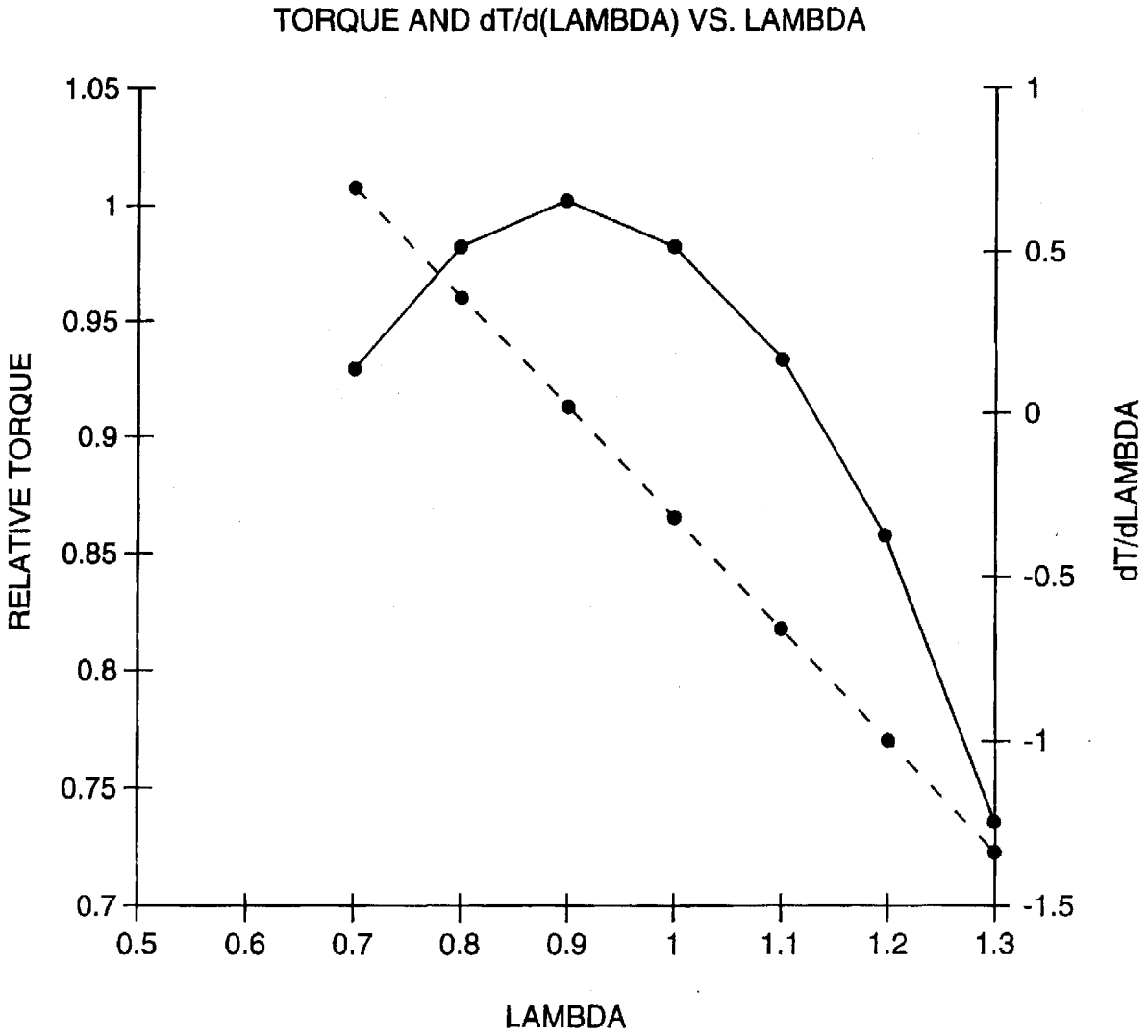
FIG. 5 is a graph illustrating the relationship between engine torque and dT/d(Lamda) vs. Lambda.

The fundamental relationship upon which the metric is based is illustrated in FIG. 5. The fuel pulse width modulation used to generate the metric varies the A/F ratio and Lambda ($\lambda$). This action, in effect, differentiates the engine torque curve, resulting in the $dT/d\lambda$ vs. $\lambda$ relationship, as also shown in FIG. 5. This is noted to be a single valued, almost linear, function with a negative slope. For a given torque vs. $\lambda$ function, this results in a unique relationship between the metric, which is proportional to engine acceleration, which is in turn proportional to engine torque, and $\lambda$. Since different speed/load points have different torque curves, account for this is taken by using engine state variables in addition to the metric in the A/F ratio estimator, as discussed earlier.

The basic relationship between the metric and A/F is discussed. Torque, T, is known to be a strong function of A/F. But torque T is proportional to angular acceleration, $T \propto a$. Therefore, we can expand the acceleration a as a function of A/F:

$$a = a_0 + \partial a/\partial(A/F) * \delta(A/F).$$

The A/F modulation amplitude, $\delta(A/F)$, in the combustion cylinder is maintained approximately constant. Thus, the change in acceleration, $\delta a$, is $$\delta a = a - a_0 = \partial a/\partial(A/F) * \delta(A/F).$$

And $$\delta a = k * \delta a/\delta(A/F) = metric,$$

where k is a proportionality constant. The function $\delta a/\delta(A/F)$ vs. A/F is proportional to $\delta T/\delta(A/F)$, where T is the engine torque. Thus, $$\delta a = k * \partial T/\partial(A/F) = metric.$$

This provides the explanation for the fundamental importance of the metric in the A/F estimators, as described below. The presence of additional engine state variables and non-linear terms in the A/F estimators provides corrections for the non-ideal and complex nature of the basic engine torque vs. A/F relationship.

The method proceeds to estimate the A/F ratio based on the metric and powertrain state variables, as shown at block 82. One simple estimator used is a four parameter estimator as follows:

$$\text{Estimated A/F Ratio} = C_0 + C_1 * metric + C_2 * (metric * spk) + C_3 * (load * spk),$$

where $C_n$ are constants empirically selected through data modeling, spk equals spark advance (degrees before top dead center), and load equals normalized cylinder air mass. Typical values for the constants are $C_0$=13.08, $C_1$=0.01511, $C_2$=0.0004184, and $C_3$=0.02195. This estimator was identified from steady state operation of the engine at A/F ratios at and very near to stoichiometry, and is predominantly linear in the metric.

More complex A/F estimators based on regression analysis and on the use of artificial neural networks can also be used. A second estimator, derived from regression analysis, is as follows:

$$\text{Estimated A/F Ratio} = C_0 + C_1 * N + C_2 * N^2 + C_3 * \text{metric} + C_4 * \text{metric}^2 + C_5 * spk^2 + C_6 * (\text{load} * spk) + C_7 * (\text{fuelpw} * ect) + C_8 * (ami * tot) + C_9 * (\text{load} * iscdty),$$

where N equals rpm, fuelpw equals fuel pulse width, ect equals engine coolant temperature, ami equals (clipped) integrated cylinder air mass, tot equals transmission oil temperature and iscdty equals idle speed duty cycle. Typical values for the constants are $C_0$=9.305, $C_1$=0.004288, $C_2$=2.855×10$^{-6}$, $C_3$=0.007105, $C_4$=−1.275×10$^{-5}$, $C_5$=−0.0004005, $C_6$=0.07636, $C_7$=1.397×10$^{-5}$, $C_8$32 0.01401, and $C_9$=6.2886.

The fundamental engine variables, N, metric, load, and spark again appear in the estimator. In addition, the variables fuelpw and iscdty are present to provide improved transient accuracy. The temperature values ect and tot provide improved accuracy for changes in engine temperature. In particular, tot accounts for temperature dependent viscosity effects associated with the automatic transmission torque converter. The variable ami is included since it provides an improved indication of intake port and valve temperature during the engine warm up period when compared to ect. If an engine intake port temperature sensor were available, it could be used instead of ami. The maximum value of ami is limited to 2.0 lbm, so its effect occurs only during the first few minutes of cold start. The cross-term fuelpw*ect accounts for cold start A/F enrichment.

Figure 6:
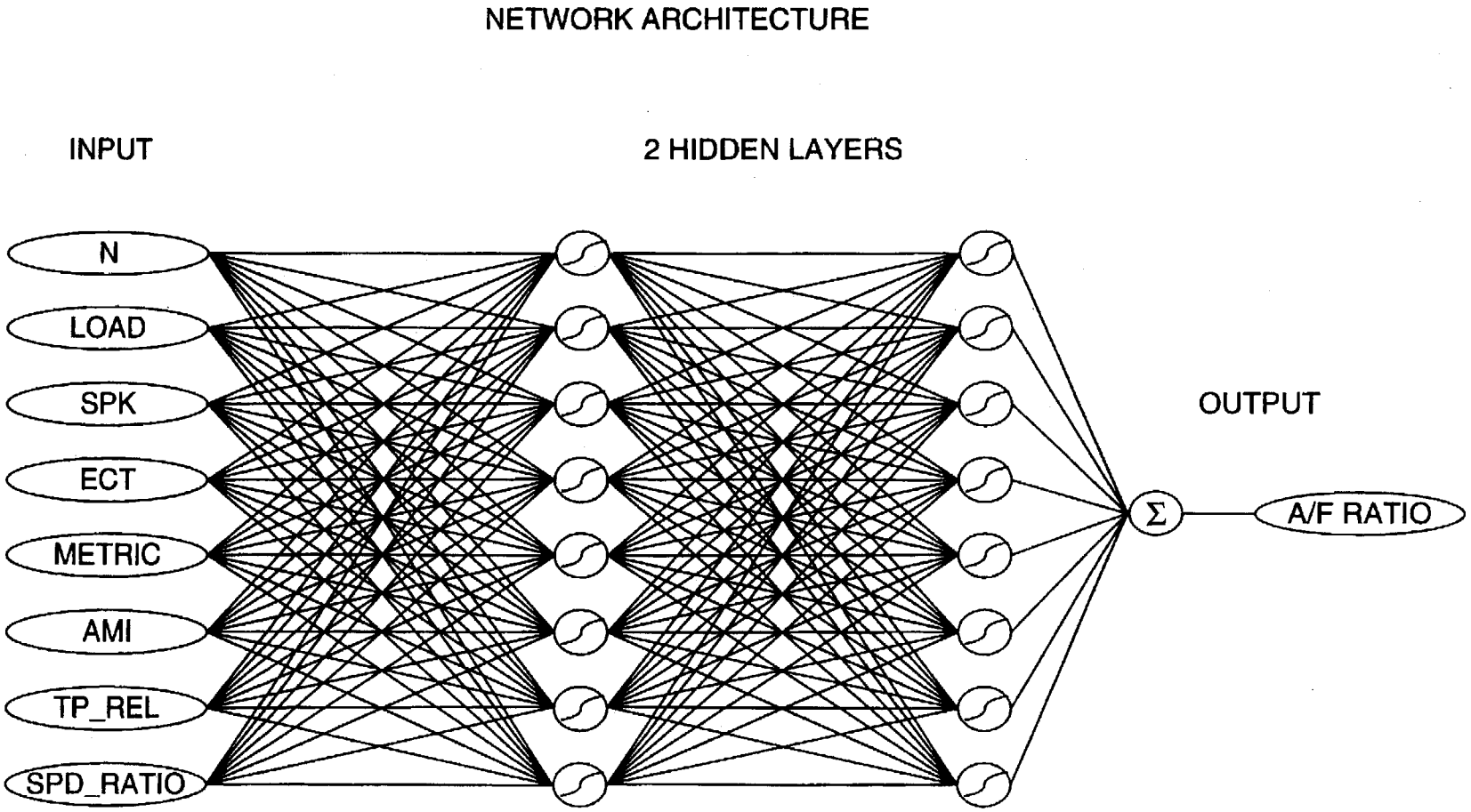
FIG. 6 is a block diagram of an artificial neural network estimator utilized in the method of the present invention.

A third estimator uses an artificial neural network, as shown in FIG. 6, having two hidden layers where the inputs are N, load, spk, ect, metric, ami, tp_rel (relative throttle position) and spd_ratio (transmission speed ratio). The neural network is trained on actual engine vehicle data using conventional backpropagation training algorithms. The training determines the values of the weights and biases in the neural network.

Since the exact form of these three A/F estimators were determined primarily through cold start engine testing near stoichiometry, it is highly probable that these estimators can be significantly simplified for the case of a fully warmed engine in lean burn operation.

Any of these estimators, all of which utilize the fundamental metric based on fuel pulse width modulation, can be used in a closed loop A/F ratio control system in which the error generated between a desired A/F ratio and the estimated A/F is applied to a conventional PID (proportional-integral-differential) controller, as will be described below. In the closed loop system, a desired A/F ratio is compared to the estimated A/F ratio to determine an A/F error, as shown at blocks 84 and 86, respectively, of FIG. 2. The desired A/F ratio is determined according to a look-up table indexed by load and engine speed.

The PID gains of the PID controller are determined, as shown at block 88, and applied to the A/F error to obtain an A/F ratio correction factor, CF, as shown at block 90. The CF is then applied to the base fuel injection mass calculation, as shown at block 92, in order to bring the estimated A/F ratio close to the desired A/F ratio. That is, the base fuel injection mass is then determined in accordance with the following: Base Fuel injection mass=(Air Mass×CF)/(14.65×Lambda).

The present invention provides a sensorless method to infer, estimate and control A/F during engine operation at lean A/F. The method relies on applying a small fuel pulse width modulation to the engine and synchronously measuring the effect of the modulation on related engine event periods. This effect is utilized in estimating A/F ratio, which is then compared to the desired A/F ratio. The difference between the estimated A/F ratio and the desired A/F ratio is used in controlling the A/F ratio to the desired A/F ratio.

While the best modes for carrying out the invention have been described in detail, those familiar with the art to which this invention relates will recognize various alternative designs and embodiments for practicing the invention as defined by the following claims.

What is claimed is:

1. A method for determining air/fuel ratio of an internal combustion engine having a fuel injector and controlling the engine accordingly, the method comprising:

sensing an engine coolant temperature and generating a corresponding temperature signal;

sensing a cylinder air mass and generating a corresponding air mass signal;

modulating a base fuel pulse width to the fuel injector according to a predetermined event schedule including a rich fuel pulse width relative to the base fuel pulse width and a lean fuel pulse width relative to the base fuel pulse width based on the temperature signal and the air mass signal;

determining a rich event time in response to the rich fuel pulse width and a lean event time in response to the lean fuel pulse width;

determining a metric based on the rich event time and the lean event time;

determining the air/fuel ratio based on the metric, the temperature signal and the air mass signal; and controlling the engine based on the determined air/fuel ratio.

2. The method as recited in claim 1 wherein controlling the engine comprises:

determining a desired air/fuel ratio based on a predetermined look-up table; and controlling the base fuel pulse width based on the desired air/fuel ratio and the determined air/fuel ratio.

3. The method as recited in claim 1 wherein modulating includes periodically alternating the rich pulse width and the lean pulse width about the base fuel pulse width.

4. The method as recited in claim 1 wherein the predetermined event schedule includes two rich pulse widths and two lean pulse widths.

5. The method as recited in claim 1 wherein determining the metric includes determining a moving average for the rich event time and the lean event time to obtain an averaged rich event time and an averaged lean event time.

6. The method as recited in claim 5 wherein determining the metric further includes determining a difference between the averaged rich event time and the averaged lean event time to obtain an averaged difference.

7. The method as recited in claim 6 wherein determining the metric further includes normalizing the averaged difference.

8. The method as recited in claim 1 wherein determining the air/fuel ratio includes determining the air/fuel ratio utilizing a regression analysis.

9. The method as recited in claim 1 wherein determining the air/fuel ratio includes determining the air/fuel ratio utilizing a neural network.

10. A system for determining air/fuel ratio of an internal combustion engine having a fuel injector and controlling the engine accordingly, the system comprising:

a temperature sensor for sensing an engine coolant temperature and generating a corresponding temperature signal;

an air mass sensor for sensing a cylinder air mass and generating a corresponding air mass signal; and control logic operative to modulate a base fuel pulse width to the fuel injector according to a predetermined event schedule including a rich fuel pulse width relative to the base fuel pulse width and a lean fuel pulse width relative to the base fuel pulse width based on the temperature signal and the air mass signal, determine a rich event time in response to the rich fuel pulse width and a lean event time in response to the lean fuel pulse width, determine a metric based on the rich event time and the lean event time, determine the air/fuel ratio based on the metric, the temperature signal and the air mass signal, and control the engine based on the determined air/fuel ratio.

11. The system as recited in claim 10 wherein the control logic, in controlling the engine, is further operative to determine a desired air/fuel ratio based on a predetermined look-up table, and control the base fuel pulse width based on the desired air/fuel ratio and the determined air/fuel ratio.

12. The system as recited in claim 10 wherein the control logic, in modulating the base fuel pulse width, is further operative to periodically alternate the rich pulse width and the lean pulse width about the base fuel pulse width.

13. The system as recited in claim 10 wherein the control logic, in determining the metric, is further operative to determine a moving average for the rich event time and the lean event time to obtain an averaged rich event time and an averaged lean event time.

14. The system as recited in claim 13 wherein the control logic, in determining the metric, is further operative to determine a difference between the averaged rich event time and the averaged lean event time to obtain an averaged difference.

15. The system as recited in claim 14 wherein the control logic, in determining the metric, is further operative to normalize the averaged difference.

16. The system as recited in claim 10 wherein the control logic is further operative to determine the air/fuel ratio utilizing a regression analysis.

17. The system as recited in claim 10 wherein the control logic comprises a neural network to determine the air/fuel ratio.

18. An article of manufacture for an automotive vehicle having an internal combustion engine, a fuel injector for injecting fuel into the engine, a temperature sensor for sensing an engine coolant temperature and generating a corresponding temperature signal, and an air mass sensor for sensing a cylinder air mass and generating a corresponding air mass signal, the article comprising:

a computer storage medium having a computer program encoded therein for modulating a base fuel pulse width to the fuel injector according to a predetermined event schedule including a rich fuel pulse width relative to the base fuel pulse width and a lean fuel pulse width relative to the base fuel pulse width based on the temperature signal and the air mass signal, determining a rich event time in response to the rich fuel pulse width and a lean event time in response to the lean fuel pulse width, determining a metric based on the rich event time and the lean event time, determining the air/fuel ratio based on the metric, the temperature signal and the air mass signal, and controlling the engine based on the determined air/fuel ratio.

* * * * *